United States Patent [19]

Tseluiko et al.

[11] 4,186,798

[45] Feb. 5, 1980

[54] TUBULAR COOLED MEMBERS OF METALLURGICAL FURNACE

[76] Inventors: Jury I. Tseluiko, prospekt Lenina, 17, kv. 55; Dorina B. Kutsykovich, prospekt Lenina, 39, kv. 54; Ljudmila A. Shabelnikova, Krasnoshkolnaya naberezhnaya, 22, kv. 101; Vladimir P. Kholopov, ulitsa 23 Avgusta, 79, kv. 54, all of Kharkov; Nikolai G. Schekin, ulitsa Cheljuskina, 75, Ljubotin Kharkovskoi oblasti; Lev D. Gritsuk, ulitsa Kombainovskaya, 13, kv. 3; Leonid B. Katsenelenbogen, ulitsa Karla Marxa, 38, kv. 18, both of Kharkov, all of U.S.S.R.

[21] Appl. No.: 872,918

[22] Filed: Jan. 27, 1978

[51] Int. Cl.[2] ..... F28F 13/08; F28F 9/26

[52] U.S. Cl. ..... 165/147; 138/38; 138/155; 165/172; 165/178; 285/157

[58] Field of Search ..... 165/146, 147, 154, 172, 165/178; 138/38, 46, 155; 285/133 R, 157

[56] References Cited

U.S. PATENT DOCUMENTS

| | | | |
|---|---|---|---|
| 2,262,530 | 11/1941 | Hamlink | 138/38 |
| 3,071,159 | 1/1963 | Coraggioso | 138/38 |
| 3,175,962 | 3/1965 | Holtslag | 165/147 |
| 3,749,155 | 7/1973 | Buffiere | 138/38 |

FOREIGN PATENT DOCUMENTS

| | | | |
|---|---|---|---|
| 1240734 | 7/1971 | United Kingdom | 285/133 R |

*Primary Examiner*—Sheldon J. Richter

[57] ABSTRACT

The tubular cooled members have straight pipes, each accommodating an insert aligned axially therewith and having a cross-section diminishing in the direction of the coolant flow in the pipe interior. These straight pipes are coupled in pairs by a bent connecting pipe fitted with an insert abutting against those enclosed in said straight pipes. The abutted pipes have the same diameters but the junctions between said pipes are displaced relative to those between the inserts, the inserts also having the same diameters at the abutted sections.

7 Claims, 3 Drawing Figures

TUBULAR COOLED MEMBERS OF METALLURGICAL FURNACE

BACKGROUND OF THE INVENTION

1. Field of the Invention

The present invention relates to heat-and-power engineering at metallurgical enterprises and, more particularly, to the design of tubular cooled members for a continuous furnace, said members being fitted with an evaporative cooling plant.

2. Description of the Prior Art

There is known in the art tubular cooled members of a metallurgical furnace, which comprises straight cooled pipes representing a supporting structure made up of long-length (up to 25 m) horizontal sections of a relatively large diameter (with an inside diameter of up to 200 mm). Accommodated coaxially in the interior of said pipes (if they are over 90 mm in diameter) are inserts (metallic rods or plugged tubes), which makes it possible to reduce the flow rate of a circulating coolant (the amount of coolant flowing through a cross-sectional area of said tubular cooled member per unit time) and to improve the cooling conditions of said pipes. In the prior-art construction a gap between the outside surface of the insert and the inside surface of the pipe in which said insert is accommodated remains the same throughout the pipe length.

However, a major problem encountered in providing the serviceability of said horizontal pipes in case of evaporation cooling is that it precludes the stratification of the coolant flow in the surface boiling zone when the fluid is subcooled, and in the zone where the boiling process is initiated, as well as in ruling out the overheating of the top generatrix of said pipes.

Since the rate of circulation is the main criterion of reliable cooling of said horizontal pipe sections and the allowable rates of circulation for the first and last sections of said pipes differ in value, it turns out that, with a constant gap between the outside surface of the insert and the inside surface of the pipe in which said insert is accommodated, the rate of circulation for the last pipe section is much greater than its allowable value, which is determined by the optimum values of pressure loss. This is evidenced by a reduction in the allowable rate of circulation stemming from an ever-growing rate of coolant flow moving along the tubular cooled member due to an increase in the vapour content under a higher total heat load. This gives rise to an undue hydraulic resistance, does not allow the requisite circulation rates to be provided at the beginning of the tubular cooled member and adversely affects the cooling efficiency.

In establishing circulation circuits with the total heat loads approximating each other, the straight cooled pipes forming a tubular cooled member are coupled in pairs with a bent connecting pipe.

The aforesaid inserts were introduced only into the straight pipe sections. This non-continuous arrangement of the inserts caused disturbances in the dynamics of the coolant flow in the transition section, i.e. in the place where the coolant passes from said straight pipe into the bent connecting pipe, the top part of said bent connecting pipe being damaged as a result.

The use of bent connecting pipes with diminishing cross-sections made it possible to decrease, but did not completely eliminate, these failures in view of the possibility of plugging the cross-section of said bent connecting pipe, if the insert is shifted to some extent, and because of the presence of said transition section between the straight and bent connecting pipes, the cross-section of said transition section substantially exceeding that of the bent connecting pipe.

Another disadvantage of the prior-art construction lies in the provision of a great number of welded joints which must meet exacting requirements as to their quality (at a pressure in the cooling system of up to 45 atm and considerable dynamic loads).

In view of the above disadvantages it was not always possible to insure the requisite rate of the coolant circulation. As for the failure of the tubular cooled members that took place in the course of operation of said cooling plants, for the most part they occured in the first horizontal sections in the zone of the top generatrix of the pipe. Characteristic of the damaged places were the thinning and distortion (bulging) of the pipe walls and the appearance of through holes which were indicative of a vapour phase corrosion attack resulting from overheating due to an inadequate coolant circulation rate.

SUMMARY OF THE INVENTION

A main object of the present invention is to provide tubular cooled members which will make it possible to assure a better cooling efficiency, extend the service life of said tubular cooled members owing to a reduction in the hydraulic resistance in the coolant flowing zone with a greater vapour content, increase the rate of circulation, improve the heat transfer conditions in the zone of surface boiling of subcooled water and eliminate the possibility of stratification into steam and water in the boiling zone.

Another no less important object of the invention is to enhance the operating reliability of the tubular cooled members by eliminating the possibility of insert displacement and eliminating a considerable number of welded joints.

A specific object of the invention is to reduce the metal requirements for producing pipelines running to an evaporative cooling plant.

Still another object of the invention is to simplify the manufacture of bent connecting pipes by making them with a constant cross-section and similar in diameter to straight pipes.

Another no less important object of the invention is to provide a reduction in power consumption for plants with forced coolant circulation.

These objects are achieved by providing tubular cooled members of a metallurgical furnace, which comprises straight cooled pipes, the interior of each pipe accommodating an insert axially aligned therewith. According to the invention, the insert diminishes in cross-section in the direction of the coolant flow.

Such a constructional arrangement of the insert makes it possible to reduce the hydraulic resistance in the zone with moderate and large vapour contents, thereby providing better cooling efficiency, improving cooling conditions and extending the service life of said tubular cooled members.

It is expedient that the insert be made of abutting parts, which facilitates the manufacture thereof, particularly when the length of said insert exceeds 10 m.

It is preferable that the gap between the outside surface of said insert and the inside surface of the pipe in which it is accommodated vary in a range between 12 and 30 mm. It assures a higher coolant flow rate and a better cooling efficiency for sections arranged in the most unfavourable zone, from the standpoint of cooling conditions, and most frequently subjected to damage, and maintains a sufficient coolant flow rate at other sections.

It is advisable that the straight cooled pipes be coupled in pairs with the bent connecting pipe and the insert be arranged concordantly to the longitudinal axis of said connecting pipe and abutted against the inserts accommodated in the straight cooled pipes, the abutted pipes being made with the same diameters and the abutted inserts also having the same diameters at their junctions.

Such a design provides a coolant flow with a structure having a fine stream of bubbles and better cooling conditions for the straight cooled pipes adjoining said bent connecting pipe. The use of a heated bent connecting pipe ensures better cooling conditions and more reliable operation of said bent connecting pipe.

It is preferable that the junction between each straight cooled pipe and the bent connecting pipe be displaced relative to the place of connection of its insert with the insert accommodated in said bent connecting pipe. This embodiment ensures easy manufacture and mounting of said inserts.

Each pair of said inserts can be abutted against each other by a metallic stud and a recess provided respectively in the abutted sections of said inserts.

Such an embodiment ensures convenient mounting and dismounting of the tubular cooled members with bent connecting pipes.

BRIEF DESCRIPTION OF THE DRAWINGS

The present invention will be better understood from a consideration of a detailed description of an exemplary embodiment of tubular cooled members for a metallurgical furnace to be had in conjunction with the accompanying drawings. In the drawings.

DETAILED DESCRIPTION OF THE INVENTION

Figure 1:
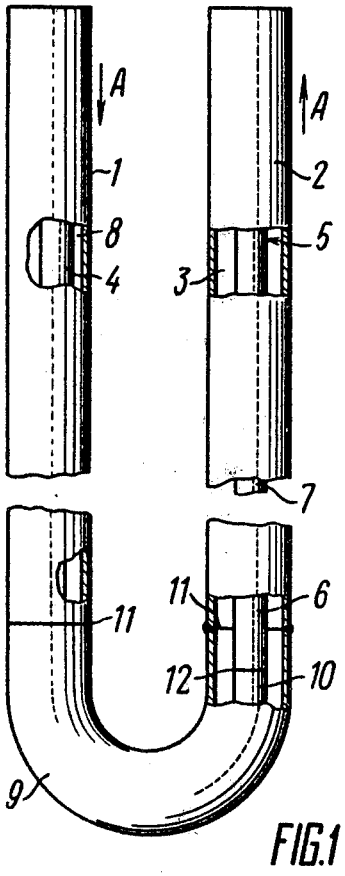
FIG. 1 is a plan view, partially broken away, of the tubular cooled members.

Referring now to the drawings and to FIG. 1 in particular, there is shown therein tubular cooled members of a metallurgical furnace, which comprise straight pipes 1 and 2, the interior 3 of each pipe accommodating coaxial inserts 4 and 5 and being made with a cross-section diminishing in the direction of the coolant flow (as shown by arrow A).

To enable more convenient fabrication the insert 5 is made up of two parts 6 and 7 abutted against each other.

Between the outside surface of the insert 4 and the inside surface of the pipe 1 in which said insert is accommodated, there is provided a gap 8 which may vary in the range between 12 and 30 mm depending on the coolant parameters.

When two straight pipes 1 and 2 are coupled with a bent connecting pipe 9 accommodating an insert 10 running concordantly to the longitudinal axis of the pipe 9, the inserts 4 and 5 enclosed in said pipes 1 and 2 are abutted against the insert 10 accommodated in said connecting pipe 9, the abutted pipes 1,2 and 9 being similar in diameter at the junction points.

The junction 11 between each straight cooled pipe 1 and 2 and the bent connecting pipe 9 is displaced relative to the junction 12 between the insert 5 and the insert 10 accommodated in said bent connecting pipe 9, the inserts 5 and 10 having the same diameters or cross-sections (where use is made of the inserts having other than circular configuration) at their junction 12.

Figure 2:
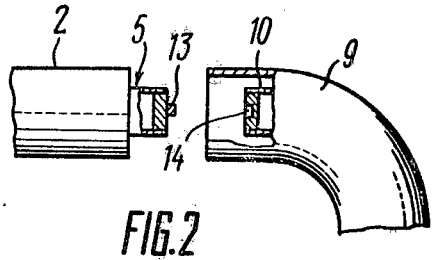
FIG. 2 is an enlarged, plan view showing the junction of an insert of a straight pipe with the insert of a bent connecting pipe.

To enable more convenient mounting and dismounting of the inserts 5 and 10 which are accommodated respectively in the pipes 2 and 9, a stud 13, shown in FIG. 2 is provided on the insert 5 and a recess 14 is provided in the insert 10 to receive the stud 13.

Figure 3:
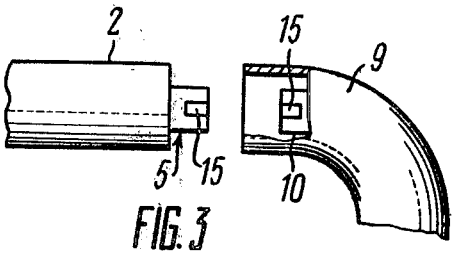
FIG. 3 is an enlarged, plan view showing the straight and connecting pipes and inserts with centering studs accommodated therein.

For aligning the inserts 5 and 10 use is made of studs 15, such as shown in FIG. 3, arranged at intervals on the outside surface of said inserts 5 and 10. The furnace has several pairs of said straight pipes 1 and 2 interconnected with a pipe 9, pairs being similar to those described hereinbefore.

The herein-proposed tubular cooled members function in the following manner.

A coolant is fed in the direction of arrow A into the annular gap 8 (see FIG. 1) defined in the straight cooled pipe 1 with the aid of the insert 4.

The tubular cooled members are subdivided in accordance with the process into three sections in the direction of the coolant flow. The first one comprises the part of the straight cooled pipe 1 wherein a subcooled coolant is flowing.

The coolant also commences to boil in that section. The second section of the tubular cooled members includes a zone of moderate boiling of the coolant, said zone comprising the end of the first straight pipe 1, the bent connecting pipe 9 and the beginning of the straight pipe 2. The third section constitutes a zone wherein the coolant has a large vapour content and comprises the central portion and the end of the straight pipe 2.

In accordance with the adopted process, subdivision of said cooled pipes 1,9, 2 and inserts 4,10 and 5, the gap 8 between the corresponding inside walls of the cooled pipes 1,9 and 2 and the outside surfaces of the inserts 4,10 and 5 ranges for the first section from 12 to 18 mm, for the second section from 18 to 25 mm, and for the third one from 25 to 30 mm.

In this case the ratio between the inside diameter of the straight pipes and the outside diameter of the inserts varies in the following ranges: between 1.2 and 1.4 for the first section; between 1.4 and 1.6 for the second one and between 1.6 and 2.0 for the third section.

Test results have proved the effectivenss of engineering solutions followed in this invention, the possibility of diminishing materially the hydraulic resistance and the enhancement of the coolant flow rate in the first section of the tubular cooled member.

The present invention obtains optimum coolant rates at minimum values of hydraulic resistances along with an increased circulation flow rate and better cooling efficiency.

Moreover, it is possible to employ cooling systems with removed drums-separators, to maintain a constant flow area of the bent connecting pipe, which is of paramount importance for its reliable functioning, and to reduce the number of welded joints in the junction between the straight and bent connecting pipes, which is likewise extremely important insofar as the evaporative cooling systems of metallurgical furnaces operate at a pressure of up to 45 atm.g.p. and are subjected to considerable dynamic loads.

What we claim is:

1. Tubular cooled members for a metallurgical furnace, comprising: a plurality of straight cooled pipes; a coolant flowing through an interior of each of said straight pipes; a plurality of inserts, a respective insert being coaxially arranged in the interior of a respective straight pipe, the cross-section of each of said inserts decreasing in the direction of flow of said coolant; a bent connecting pipe coupling a pair of said straight pipes together, said connecting pipe having the same diameter as each straight pipe at a junction between said connecting pipe and that straight pipe; and an insert coaxially arranged in an interior of said connecting pipe and arranged concordantly to a longitudinal axis of said connecting pipe, said insert in said connecting pipe having the same diameter as said insert in each straight pipe at a junction between said insert in said connecting pipe and said insert in that straight pipe.

2. Tubular cooled members according to claim 1, wherein the size of a gap, defined by an outside surface of said respective insert in said respective straight pipe and an inside surface of said respective straight pipe, varies in a range between twelve and thirty millimeters.

3. Tubular cooled members according to claim 1, wherein said junction between said connecting pipe and a respective straight pipe is displaced from said junction between said insert of said connecting pipe and said insert of said respective straight pipe.

4. Tubular cooled members according to claim 1, wherein said inserts of each of said straight pipes is provided with a stud, and said insert of said connecting pipe is provided with a recess into which said stud of said insert of a respective straight pipe fits.

5. Tubular cooled members according to claim 1, wherein each of said inserts of each of said straight pipes is made of two abutting parts.

6. Tubular cooled members according to claim 1, wherein said members are divided into three sections, a first section consisting of a first straight pipe and having a length between twelve and eighteen millimeters, a second section consisting of an end of said first straight pipe, said connecting pipe and an end of a second straight pipe and having a length between eighteen and twenty-five millimeters, and a third section consisting of said second straight pipe and having a length between twenty-five and thirty millimeters.

7. Tubular cooled members according to claim 6, wherein the ratio between the inside diameter of said respective straight pipe and the outside diameter of said insert in said respective straight pipe varies between 1.2 and 1.4 in said first section, 1.4 and 1.6 in second section, and 1.6 and 2.0 in said third section.

* * * * *